US007785382B2

(12) United States Patent
Morton

(10) Patent No.: US 7,785,382 B2
(45) Date of Patent: Aug. 31, 2010

(54) EXHAUST HOOD WITH GREASE ABSORBING MATERIAL ON A ROLL

(75) Inventor: Philip O. Morton, Portland, OR (US)

(73) Assignee: Illinois Tool Works Inc, Glenview, IL (US)

( * ) Notice: Subject to any disclaimer, the term of this patent is extended or adjusted under 35 U.S.C. 154(b) by 738 days.

(21) Appl. No.: 11/673,794

(22) Filed: Feb. 12, 2007

(65) Prior Publication Data

US 2007/0204854 A1 Sep. 6, 2007

Related U.S. Application Data

(60) Provisional application No. 60/776,136, filed on Feb. 23, 2006.

(51) Int. Cl.
*B01D 50/00* (2006.01)

(52) U.S. Cl. ..... 55/332; 55/354; 55/DIG. 36

(58) Field of Classification Search ..... 55/320, 55/332, 351, 354, DIG. 36
See application file for complete search history.

(56) References Cited

U.S. PATENT DOCUMENTS

| | | | | |
|---|---|---|---|---|
| 700,858 | A | 5/1902 | Thomas | |
| 3,260,189 | A * | 7/1966 | Jensen | 126/299 D |
| 4,303,420 | A * | 12/1981 | Howard | 96/230 |
| 4,336,038 | A | 6/1982 | Schultheiss et al. | 55/274 |
| 4,689,058 | A | 8/1987 | Vogt et al. | 55/279 |
| 4,737,174 | A | 4/1988 | Pontius | 55/316 |
| 5,211,159 | A | 5/1993 | Lieblein et al. | 126/299 |
| 5,419,953 | A | 5/1995 | Chapman | 428/284 |
| 5,470,365 | A | 11/1995 | Jang | 55/510 |
| 5,522,377 | A | 6/1996 | Fritz | 126/299 |
| 5,906,195 | A | 5/1999 | Georgaras | 126/299 |
| 6,041,772 | A | 3/2000 | Ward et al. | 126/229 |
| 6,041,774 | A | 3/2000 | Ward et al. | 126/299 |
| 6,058,929 | A | 5/2000 | Fritz | 156/299 |
| 6,162,286 | A | 12/2000 | Hasama et al. | 96/231 |
| 6,293,983 | B1 | 9/2001 | More | 55/486 |
| 6,814,769 | B1 | 11/2004 | Stefanucci | 55/385.1 |
| 6,843,834 | B2 | 1/2005 | Schumacher | 95/277 |
| 6,878,175 | B2 | 4/2005 | Keller et al. | 55/320 |
| 2005/0150382 | A1 | 7/2005 | Sheehan et al. | 95/277 |

FOREIGN PATENT DOCUMENTS

| | | |
|---|---|---|
| EP | 1111312 | 11/2000 |

* cited by examiner

*Primary Examiner*—Robert A Hopkins
(74) *Attorney, Agent, or Firm*—Taylor IP, P.C.

(57) ABSTRACT

A kitchen exhaust air cleaning system includes a dispenser and a receiver, with a supply spool of grease absorbent material provided in the dispenser. Contaminated portions of the web can be selectively removed from the air flow path into the receiver while drawing uncontaminated portions of the web from the dispenser to the path of air flow.

10 Claims, 5 Drawing Sheets

EXHAUST HOOD WITH GREASE ABSORBING MATERIAL ON A ROLL

CROSS-REFERENCE TO RELATED APPLICATIONS

The present regular U.S. patent application claims the benefits of U.S. provisional application for patent Ser. No. 60/776,136 filed on Feb. 23, 2006.

FIELD OF THE INVENTION

The present invention relates generally to exhaust systems for kitchens having hoods over cooking appliances, and more particularly, the invention pertains to grease filters for removing grease from the grease laden air exhausted from kitchens, and still more particularly to grease filters using replaceable grease absorbing or grease capturing material to remove grease particles from an air stream.

BACKGROUND OF THE INVENTION

Exhaust hoods are provided in cooking areas to remove smoke, steam and odors from kitchens. High temperature air exhausted from a cooking area often is laden with grease and other contaminants. It is desirable to remove the grease and other contaminants before the air is released into the atmosphere, so that clean air is exhausted. Further, it is desirable to remove a substantial portion of such contaminants early in the exhaust system, so that only a minimal amount of equipment and ducting near the exhaust system entrance is contaminated and requires frequent cleaning. A variety of different filters, screens and contaminant removal devices are known for kitchen exhaust hoods.

It is known to use fibrous batts of absorbent material to capture contaminant particles from kitchen air stream exhaust flows. Individual pieces or batts of the absorbent material are positioned in the exhaust hood. When the batts become unacceptably contaminated or filled and replacement is required, each batt or filter element is removed and replaced individually. A large kitchen hood, such as those sometimes found in commercial kitchens spanning several cooking locations, can require a plurality of individual fiber batts. To replace each batt requires access along a substantial area of the kitchen hood, which may include access directly over cook tops, griddles, grills and other hot and/or difficult to access locations. Accordingly, replacement of the individual filter batts can be both time consuming and inconvenient.

SUMMARY OF THE INVENTION

The present invention provides apparatus for dispensing, repositioning and removing an elongated web of rolled absorbent material, such as, for example, absorbent wool, to remove grease in a kitchen exhaust hood air stream.

In one aspect thereof, the present invention provides a kitchen exhaust system with an exhaust hood and an exhaust duct, an air mover associated with the exhaust hood and duct for establishing an air flow therethrough. A grease collector includes an elongated web of grease collecting material, a dispenser from which lengths of the material are selectively exposed to the air flow; and a receiver for gathering portions of the material previously exposed to the air flow.

In another aspect thereof, the present invention provides a grease collecting system for removing particles from an air stream, with a fire barrier grease baffle including a drain, and a pre-filter upstream of the fire barrier grease baffle. The pre-filter includes a dispensing box, a receiving box; and a grease collecting web extending from the dispensing box to the receiving box. A yet to be used portion of the web is disposed in the dispensing box, a previously used portion of the web is disposed in the receiving box and a currently used portion of the web is disposed between the dispensing box and the receiving box. The yet to be used portion, the currently used portion and the previously used portion are contiguous.

In a still further aspect thereof, the present invention provides a process for replacing contaminated grease absorbent wool in a grease collector of a kitchen exhaust system including steps of dispensing an uncontaminated portion of wool by unrolling the wool from an elongated web of the wool disposed on a spool, the uncontaminated portion being contiguous with the contaminated wool being replaced; removing the contaminated portion of the web from an air flow path of the exhaust system; moving the uncontaminated portion dispensed from the spool into the airflow path by pulling the uncontaminated portion with the contaminated portion; and accumulating the removed contaminated web portion.

Other features and advantages of the invention will become apparent to those skilled in the art upon review of the following detailed description, claims and drawings in which like numerals are used to designate like features.

Figure 1:
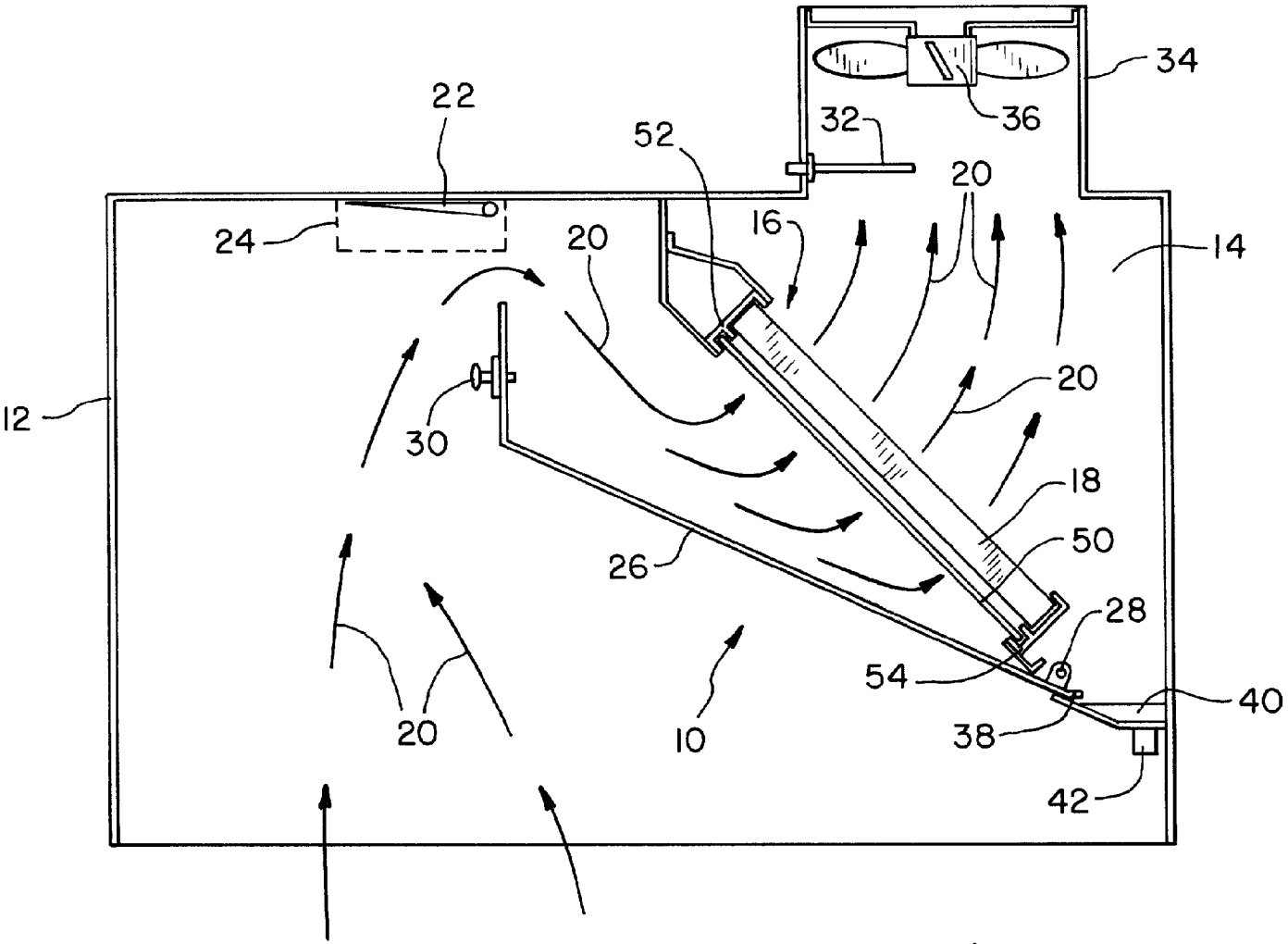
FIG. 1 is a cross-sectional view of a kitchen exhaust system in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

With reference now more particularly to the drawings and to FIG. 1 in particular, a kitchen exhaust system 10 in accordance with the present invention is shown. Exhaust system 10 is provided with an exhaust hood 12 generally located above, behind or otherwise near a cooking station such as a stovetop, cooking grill, griddle or other food preparation area. An exhaust hood plenum 14 is provided to gather the air to be exhausted. A grease and other contaminants rolled material collector 16 is provided at an inlet to exhaust hood plenum 14 for removing a substantial portion of grease and other contaminants from air flow through plenum 14. A fire barrier grease baffle 18 and other contaminant removal devices can be provided in cooperation with rolled material collector 16, either upstream or downstream thereof. In the exemplary embodiment shown in FIG. 1, grease collector 16 is provided as a pre-filter upstream of fire barrier grease baffle 18.

Air flow through exhaust system 10 is illustrated in FIG. 1 by arrows, some of which, but not all of which have been designated with the reference numeral 20. Air flow into exhaust hood plenum 14 is controlled by a damper 22, which may be manually operated or automatically operated via a damper motor 24. Flame guard doors 26 pivotal about a pivot 28 are provided in the exemplary system shown in FIG. 1. A latch 30 is provided for securing flame guard doors 26, and to release the doors for servicing.

A thermostat 32 can be used in an exhaust duct 34 leading from exhaust hood plenum 14, for controlling operation of an exhaust fan 36, various dampers and controls in exhaust system 10, including, for example, damper 22 by operation of damper motor 24. The use of thermostats to control dampers, fans and other exhaust system components is well-known to those skilled in the art and will not be described in further detail herein. Exhaust fan 36 is operable to establish air flow 20 throughout kitchen exhaust system 10.

Also illustrated in the exemplary embodiment of FIG. 1 are a grease runoff trough 38, a grease gutter 40 and a drain 42 by which accumulated grease is removed from exhaust system 10. The use of grease collecting components such as grease runoff trough 38, grease gutter 40 and drain 42 are well-known to those skilled in the art and will not be described in further detail herein.

Figure 2:
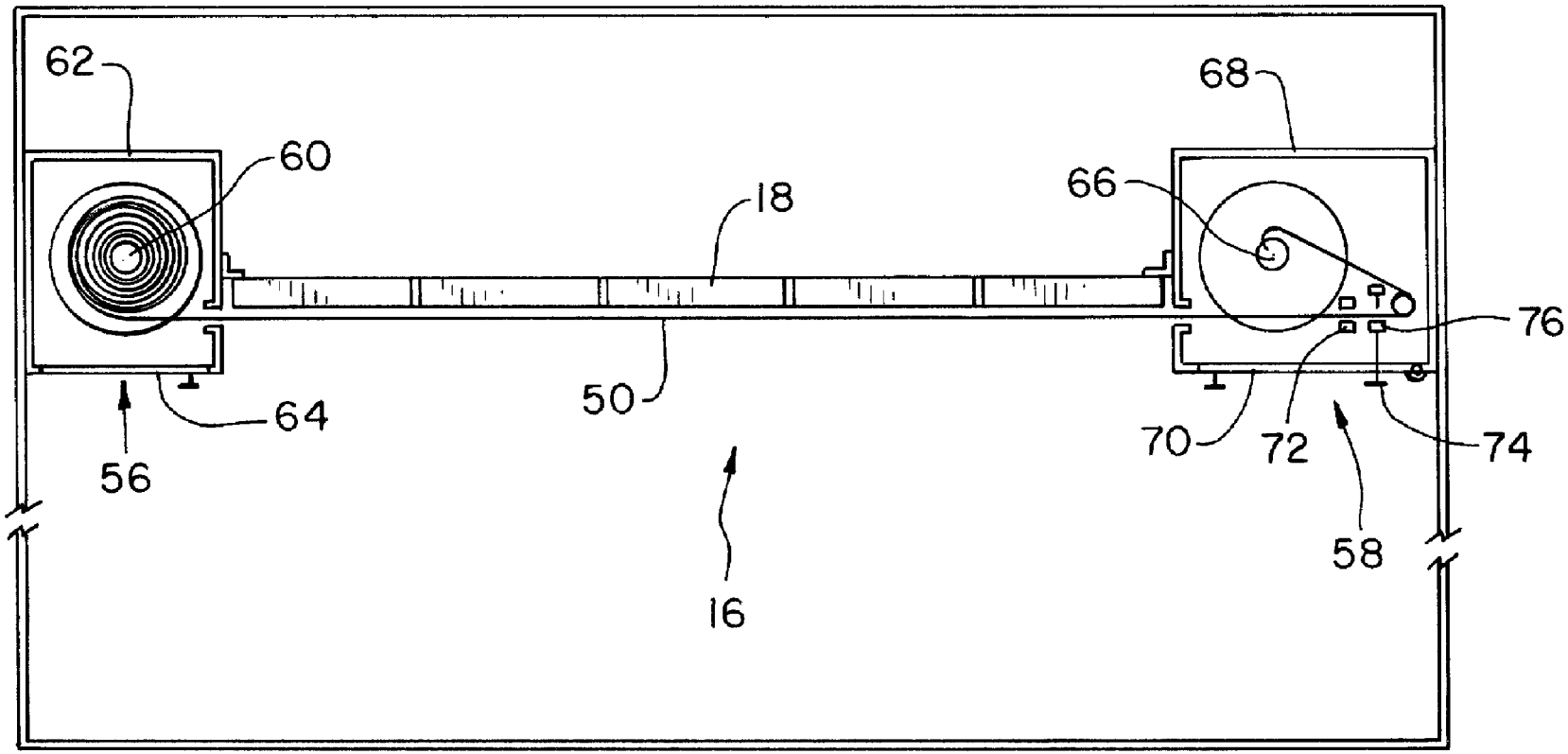
FIG. 2 is a cross-sectional view of a rolled material filter provided in the exhaust system shown in FIG. 1.

Rolled material grease collector 16 includes an elongated web of absorbent material web 50 of natural or synthetic fibers which can be woven or nonwoven. In one embodiment, a woven absorbent material web 50 of natural wool is used; however, the present invention can be used with other natural and synthetic filter materials. Material web 50 is constrained against fire barrier grease baffle 18 and is held within first and second tracks 52 and 54 providing edge support to material web 50 along opposite edges of material web 50. Material web 50 and tracks 52, 54 extend between a dispenser 56 and a receiver 58 (FIG. 2). Material web 50 thereby spans airflow path 20.

Dispenser 56 includes a rotatable dispensing spool 60 holding an unused supply of material web 50 in a housing or dispensing box 62 having an access panel or door 64 providing access to the interior of box 62 for removing empty spools 60 from which material web 50 has been dispensed and for installing replacement spools 60 holding a fresh supply of material web 50. Material web 50 extends across the airflow path defined by hood plenum 14 against fire barrier grease baffle 18 and is accumulated in receiver 58 on a rotatable receiving spool 66 in a housing or receiving box 68. An access door 70 is provided in box 68 for removing spools holding used material web 50 and for inserting empty spools to take up material web 50. Web tension guides 72 are provided and can be in the nature of rollers or slides nipped against material web 50 to establish an appropriate grip or clamp on material web 50 to develop and retain a desired tension in the material. A cutter handle 74 and cutter blade 76 are operable across the width of material web 50 to sever material web 50 to remove used portions thereof or when removing a receiving spool 66 holding grease-laden material web 50.

Figure 3:
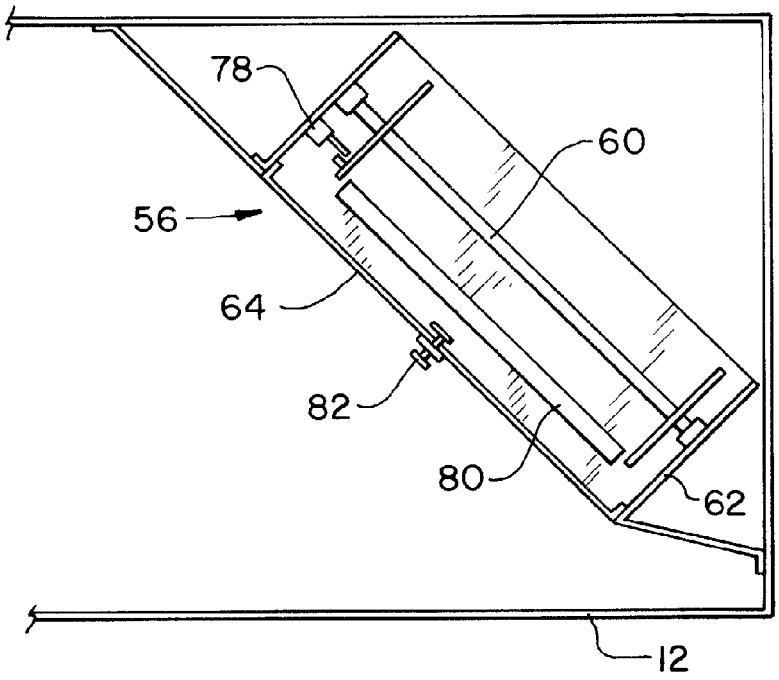
FIG. 3 is a cross-sectional view of a dispensing box for the filter shown in FIG. 2.

As illustrated in the more detailed view of FIG. 3, in which for clarity purposes material web 50 is not shown, dispenser 56 includes a spool lock 78 to secure dispensing spool 60 against rotation so that appropriate tension can be provided on material web 50 exposed within hood plenum 14. Spool lock 78 can be selectively disengaged or engaged as required for allowing rotation of spool 60 when dispensing material web 50 from spool 60, or for constraining spool 60 against rotation. Dispensing box 62 is provided with a dispensing box guide slot 80 through which material web 50 is dispensed. A latch 82 is provided on access door 64.

Figure 4:
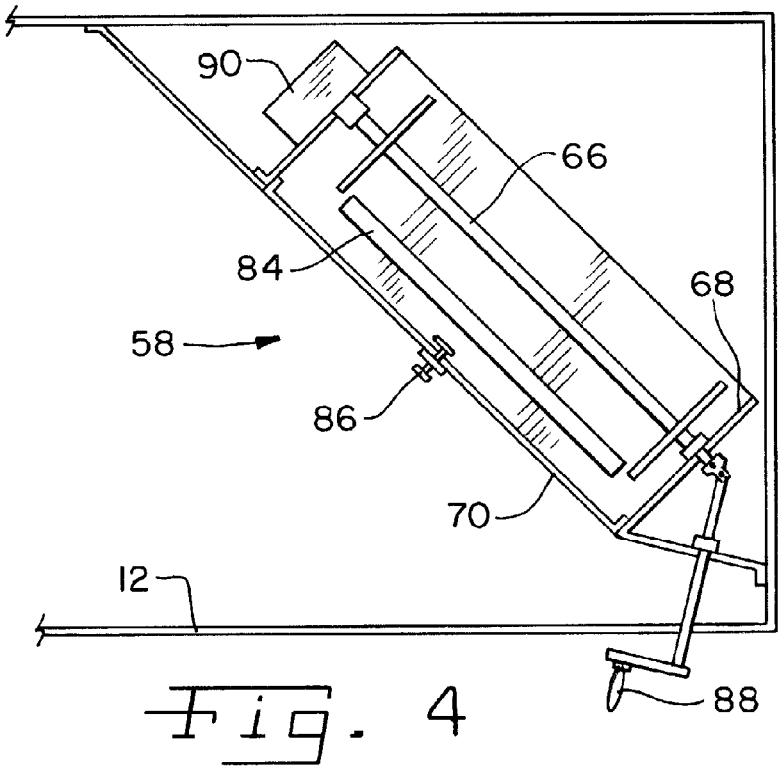
FIG. 4 is a view of a receiving box for the filter shown in FIG. 2, with an entrance side panel thereof broken away to reveal inner components of the box.

FIG. 4 illustrates receiver 58 in greater detail and without material web 50 being shown. A receiving box guide slot 84 is provided in receiving box 68 through which material web 50 enters receiving box 68. A latch 86 is provided on access door 70.

Receiving spool 66 can be manually driven or automatically driven. A hand crank 88 is used to manually rotate receiving spool 66 and pull material web 50 from dispensing spool 60. By drawing contaminated material into receiving box 68 via guide slot 84, the material is wound on receiving spool 66 and a clean portion of material web 50 is dispensed from dispensing spool 60 and is moved to then be exposed to air flow 20. The entire previously exposed portion of material web 50 can be collected on receiving spool 66 or only a portion of the previously exposed material web 50 can be collected. Partial collection can be advantageous when different areas of material web 50 are exposed to different amounts of contaminant. Since material web 50 remains contiguous throughout the length thereof from unused portions in dispenser 56 through in-use portions spanning airflow path 20 and including any accumulated used portion in receiver 58, the material can be replaced by only accessing receiver 58 to pull material web 50 along its length. Accordingly, it is not necessary to access the entire span of the filter area, as is required when individual bats are used and replaced.

An automatic system can be used for driving receiving spool 66 so that manual operation is not required and scheduled, periodic operation can occur. An exemplary automatic system can include a drive motor 90 for rotating receiving spool 66 when a clean portion of material web 50 is to be moved into air flow 20. Drive motor 90 can be controlled automatically to operate based on one or several conditions, or drive motor 90 can be selectively operated by human intervention. For example, motor 90 can be automatically activated when a given period of time has elapsed. Motor 90 can be activated when a predetermined operational time has passed for exhaust system 10, such as after exhaust fan 36 has been operated for a pre-established time interval. Other control sequences and parameters also can be used, such as the detection of increased power requirements for exhaust fan 36 to effect a given air flow through material web 50, indicating loading of contaminants in the material increasing airflow resistance through the material.

Cutter blade 76 can be used to sever the material whenever dirty or contaminated material has been accumulated in receiver 58. In this way, contaminated material can be removed soon after it has been accumulated in receiver 58, and not retained therein for a prolonged time period. While a spool can be used for windup, the used portion of absorbent material web 50 can be gathered or accumulated in receiving box 68 without winding on a spool. If receiving spool 66 is not used, and the end of material web 50 is not secured to spool 66, web tension guides 72 can be nip rollers, tractor drive wheels or the like driven by a motor or hand crank to facilitate moving material web 50 and securing the position thereof to maintain tension of the exposed portion of material web 50 during use, with dispensing spool 60 held against rotation by spool lock 78. Material web 50 can be moved also by manually pulling the web.

Figure 5:
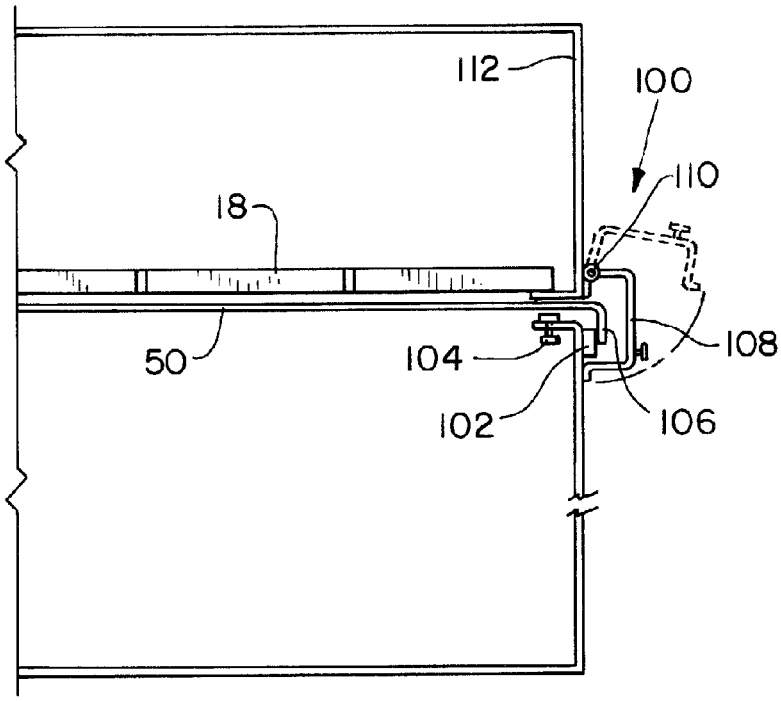
FIG. 5 is a cross sectional view according to another embodiment of the present invention.

FIG. 5 illustrates a receiver 100 with which a contaminated portion of material web 50 is gathered and immediately removed when replaced within the airflow. Receiver 100 includes a cutting board 102 against which cutter blade 76 can be operated. Material web 50 also can be severed by use of an independent cutting implement such as a utility knife or the like. A clamp 104 is provided to secure a relatively short tail portion 106 of material web 50. Clamp 104 is loosened to allow movement of web 50 for repositioning to locate clean portions in the air flow and to remove contaminated portions into receiver 100. Clamp 104 is then tightened to secure the position of a web 50. Thereafter, the contaminated portion can be severed and disposed of. A cover 108 secured by a hinge 110 to exhaust hood 112 covers and protects cutting board 102 and tail portion 106. Material web 50 can be grasped and pulled manually after clamp 104 is released.

Figure 6:
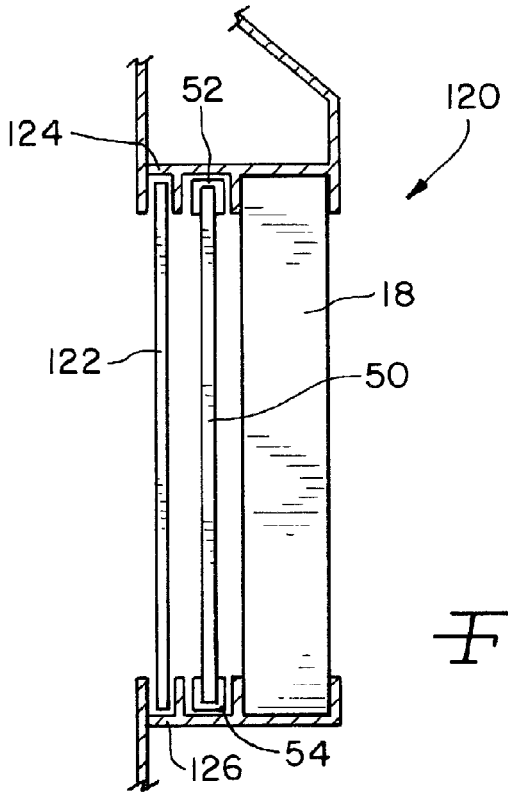
FIG. 6 is a cross-sectional view of still another embodiment of the present invention.
Figure 7:
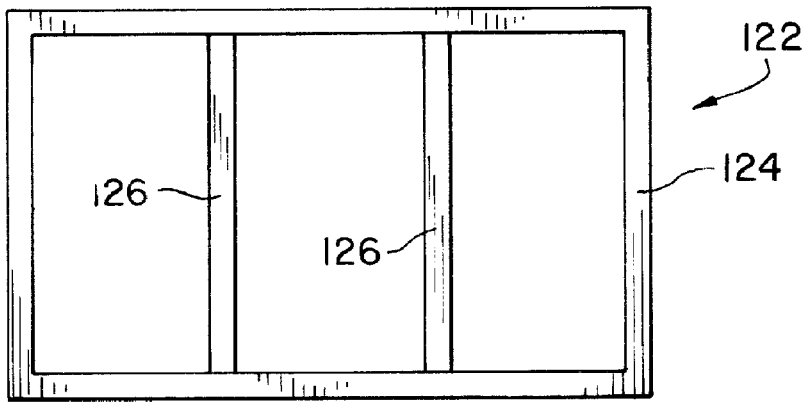
FIG. 7 is a front view of a restraining grid for the embodiment of the present invention shown in FIG. 6.

FIG. 6 illustrates a rolled media grease collector 120 having material web 50 disposed in tracks 52 and 54 in front of grease baffle 18 as described previously. A restraining grid 122 is provided in channels 124, 126 upstream of material web 50 to effectively restrain material web 50 between grease baffle 18 and grid 122. Grid 122 can be of different shapes and configurations and in the exemplary embodiment includes an outer frame 124 and intermediate bars 126 (FIG. 7). It should be understood that the overall shape and size will be selected for the surface presented in the rolled media grease collector 120 and may include bars transverse to intermediate bars 126 as well as bars of other shapes, such as honeycomb shape and the like. Grid 122 can be a metal or other noncombustible material. Use of this embodiment can be particularly effective when large areas of material web 50 are exposed and subject to sag. Further, grid 122 can provide advantages in retaining the position of material web 50 in the event of fire or other events that disrupt the web integrity of material web 50.

Figure 8:
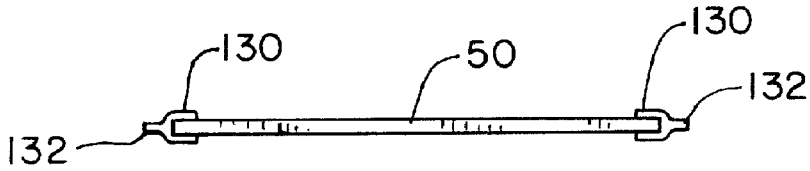
FIG. 8 is a cross-sectional view of the material web according to still another embodiment of the present invention.
Figure 9:
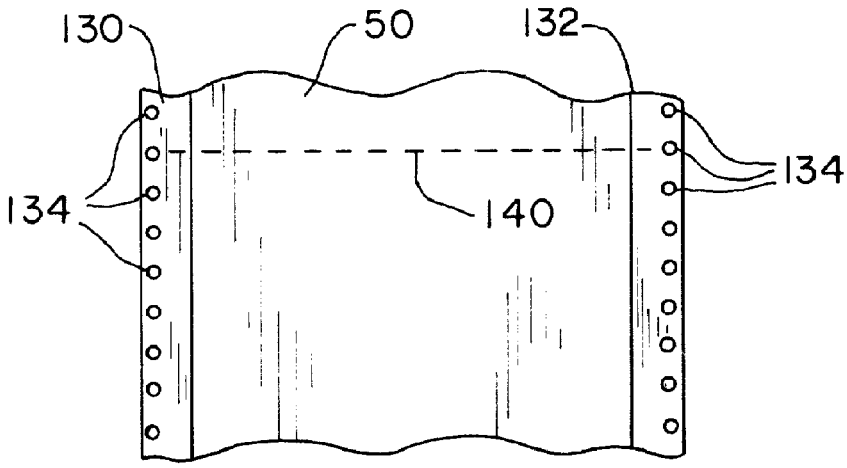
FIG. 9 is a fragmentary front view of the material web according to the embodiment shown in FIG. 8.

As illustrated in the embodiment of FIG. 6, strips of edge reinforcements 130 are provided on opposite edges of material web 50. Edge reinforcements 130 can be of plastic, fabrics made of natural or synthetic fibers and the like to provide a more durable and resilient edge for use with automatic drive mechanisms and/or for pulling manually against material web 50 as material web 50 slides within tracks 52, 54. Edge reinforcements 130 can overlie and encapsulate edge portions of material web 50 as shown in FIG. 6 or, as illustrated in FIGS. 8 and 9 can provide a lateral flange 132 against which drive wheels or other mechanisms can operate. To further facilitate movement of material web 50 by mechanical drive mechanisms, flanges 132 can define holes 134 for engagement by a tractor drive sprocket (not shown).

Still a further variation of the present invention is illustrated in FIG. 9 in which periodic, transverse lines of weakening 140 are provided across material web 50, thereby allowing material web 50 to be torn without the use of cutting tools or the like. Line of weakening 140 can be a line of perforations, a thinned area of material web 50 or other variation in the integrity of material web 50 to promote accurate tearing across web 50.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A grease collecting system for removing particles from a kitchen air stream, said system comprising:

a fire barrier grease baffle including a drain;

a pre-filter upstream of said fire barrier grease baffle, including:

a dispensing box;

a receiving box; and a grease collecting web extending from said dispensing box to said receiving box, with a yet to be used portion of said web disposed in said dispensing box, an end of said web and a previously used portion of said web disposed in said receiving box and a currently used portion of said web being disposed between said dispensing box and said receiving box, said yet to be used portion, said currently used portion and said previously used portion being a contiguous elongated web.

2. The system of claim 1, including a rotatable receiving spool for accumulating at least a portion of said web there on, and a drive motor operatively connected to said receiving spool for rotating said spool.

3. The system of claim 1, including a rotatable receiving spool for accumulating at least a portion of said web there on, and a hand crank operatively connected to said receiving spool for rotating said receiving spool.

4. The system of claim 1, said receiving box including a cutter adapted for severing said web across a width thereof.

5. The system of claim 1, said dispensing box including a rotatable dispensing spool having at least a portion of said web wound there on, and a spool lock for selectively constraining rotation of said dispensing spool.

6. The system of claim 1, said grease collecting web being wool.

7. The system of claim 6, said grease collecting web having edge reinforcements along opposite edges thereof.

8. The system of claim 7, said edge reinforcements defining laterally extending flanges.

9. The system of claim 8, said flanges having holes therein.

10. The system of claim 1, said web having periodic transverse lines of weakening.

* * * * *